United States Patent [19]

Speer et al.

[11] Patent Number: 4,947,806

[45] Date of Patent: Aug. 14, 1990

[54] ENGINE BREATHER OIL RECOVERY SYSTEM

[75] Inventors: Stephen R. Speer; Jan G. Norton, both of Spokane; James D. Wilson, Greenacres, all of Wash.

[73] Assignee: Machen, Inc., Spokane, Wash.

[21] Appl. No.: 346,797

[22] Filed: May 3, 1989

[51] Int. Cl.[5] ..... F01M 13/00

[52] U.S. Cl. ..... 123/41.86; 417/151; 123/198 C

[58] Field of Search ..... 123/41.86, 196 R, 196 A, 123/196 CP, 572, 573, 198 C; 417/151

[56] References Cited

U.S. PATENT DOCUMENTS

| | | | |
|---|---|---|---|
| 2,849,994 | 9/1958 | Barker | 123/41.86 |
| 3,563,674 | 2/1971 | Moffat et al. | 417/151 |
| 3,978,671 | 9/1976 | Gonzalez | 123/41.86 |

*Primary Examiner*—Noah P. Kamen

*Attorney, Agent, or Firm*—Barry G. Magidoff

[57] ABSTRACT

There is provided for use in a reciprocating engine, a motive flow pump to provide a constant suction pressure in order to draw oil from a breather oil recovery device back to the engine oil reservoir. The motive power for this pump is provided from the flow of oil from a different source.

14 Claims, 5 Drawing Sheets

ENGINE BREATHER OIL RECOVERY SYSTEM

FIELD OF THE INVENTION

Excessive oil escapage from the engine case breather outlet is a significant problem arising in the operation of many aircraft engines. This invention is of particular use in aircraft with turbocharged reciprocating engines. It relates to means for reducing the loss of oil vented from the breather of a reciprocating engine, i.e. recovery of the oil blow-by, and for returning this recovered oil to the engine oil reservoir.

BACKGROUND OF THE INVENTION

Excessive engine oil blow-by in aircraft powered by reciprocating engines has been a recognized problem for some time. This problem has become even more significant with the use of turbocharging to increase engine power output. The increase in brake mean effective pressure causes increased leakage past the piston rings, thus carrying additional oil out of the engine breather outlet. Furthermore, the more powerful engine permits aircraft to climb at a higher noseup angle of attack, causing engine oil to collect more toward the aft of the engine case. This causes more oil to collect near the engine oil breather outlet, which is commonly located at the rear of the engine, and in the past has increased the amount of oil escaping out the breather.

DESCRIPTION OF THE PRIOR ART

Existing, but not fully effective, means for the recovery of oil blow-by from the engine breather are schematically illustrated in the Prior Art figure. The general arrangement shown here consists of an aircraft engine, the aft end of which is generally designated by the numeral 5, supported by an engine support structure 55, which is rigidly connected to the aircraft frame structure 60. An oil breather recovery device, generally indicated by the number 100, is connected to the engine breather outlet 4 through a connection hose 3. The cannister inlet 2 is located in the lower portion of the cannister 1. A vapor outlet 6 is located in the upper portion of the cannister 1, and the vapor vents overboard to the atmosphere via the vapor outlet tube 7.

A secondary oil return line 11 runs from the bottom 10 of the cannister 1 directly through an inlet 12 to the engine oil reservoir. The outlet tube 7 can also include, optionally, an aft chamber at the exit 9, in order to provide a greater pressure drop, arising from external air flow past the outlet tube exit 9. Also, louvered vents 8 can be positioned along the outlet tube 7, allowing warmer air from the engine compartment to be pulled into the vapor outlet tube 7, in order to prevent icing at the exit 9.

To improve oil recovery, means for separating the oil from the engine breather gases have also been provided These generally have included cyclone-type systems, which utilize baffles to direct the flow, and filters to collect the oil or to separate it from the breather gases.

Such oil breather recovery devices, even with complete vapor/oil separation, have not proven to be fully effective in substantially eliminating or reducing the oil blow-by in turbocharged reciprocating engines. These devices provided no positive means, other than gravity, to return the recovered oil to the engine reservoir. In a further attempt to improve the recovery of blow-by oil, some prior aircraft configurations have connected the oil return line 11 to inlet 16 of the scavenge pump 15.

The scavenge pump 15 primarily draws oil from the turbocharger bearing through oil drain 17. The scavenge pump 15, in that embodiment, was intended to suck oil from both the turbocharger and the breather oil recovery device 100, combining the oil from return line 11 with the oil from the bearing oil drain 17 at the scavenge pump inlet 16.

In practice, however, this approach has not functioned adequately, because in a highly turbocharged engine, i.e., those having boost pressures well above atmospheric conditions, there is sufficient exhaust gas leakage past the turbocharger turbine seals, so that a positive, i.e., higher, pressure is produced at the scavenge pump inlet 16, than is present at the engine breather outlet 4. Under those conditions of higher engine power, when oil blow-by is at its maximum, there will be no suction force acting to pull oil from the oil recovery device 100. Also, under these high power conditions, there is sufficient positive pressure between the turbocharger bearing oil outlet and scavenge pump inlet 16, so that oil from the turbocharger could flow backwards into the oil recovery device 100 and out of the overboard tube 7 outlet. To prevent this oil back flow, a check valve 20 is placed in the oil separator return line 11. However, the closing of the check valve 20 will block the return oil flow from the recovery device 100, thus negating the function and purpose of the breather oil recovery device under high power conditions, when engine blow-by is at its maximum.

SUMMARY OF THE INVENTION

In accordance with this invention, a motive flow pump is provided between the breather oil recovery device and the engine oil reservoir, to provide a continual suction force from the breather oil recovery device. In this invention, the suction force increases with increased engine power output, thus resulting in a continuous flow of recovered oil back to the engine under all conditions of operation. A preferred embodiment of the present invention utilizes a motive suction pump, that is, a pump which provides the necessary pressure drop by tapping the energy provided from the flow of oil from another source, which increases as engine output increases, thus providing a positive feedback effect.

BRIEF DESCRIPTION OF THE DRAWINGS

In the accompanying drawings, an example of an advantageous embodiment of the apparatus in accordance with the present invention is set forth. The apparatus is for the most part shown and described in schematic terms, often in an essentially symbolic manner, because of the conventional nature of the individual portions of the apparatus. Appropriate structural details for actual operation, where not explicitly set forth, are generally known and understood and need not be set forth in greater detail herein, as they are not part of the present invention. Elimination of such unnecessary disclosure of conventional apparatus, permits greater emphasis and clarification of the scope and concept of the present invention. Where possible, conventionally available elements in the system are described generally and by reference to a specific example.

DESCRIPTION OF THE PREFERRED EMBODIMENT

Figure 1:
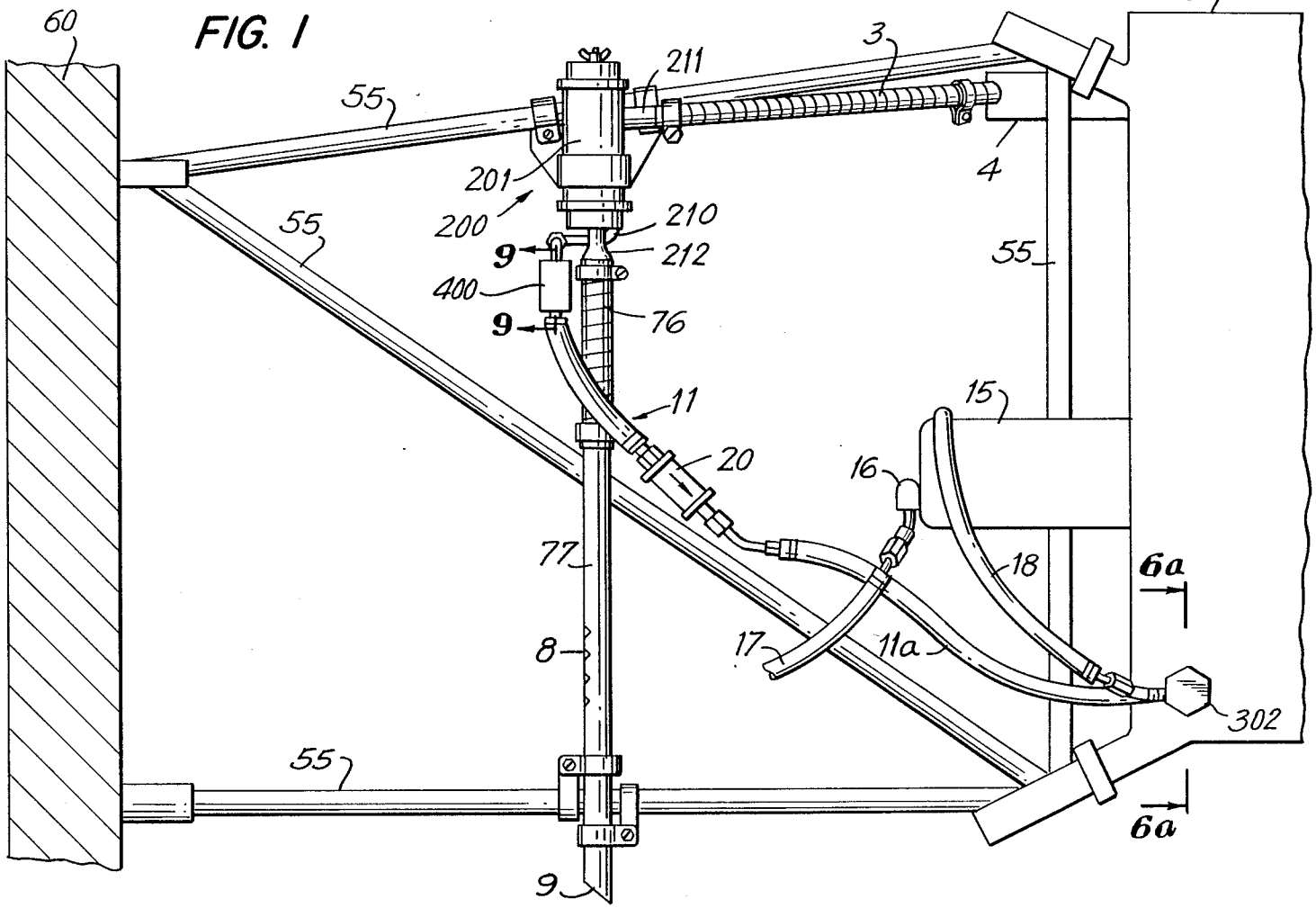
FIG. 1 is a side view diagrammatically showing a typical aircraft engine installation with a breather oil separator and return system, in accordance with the present invention.
Figure 2:
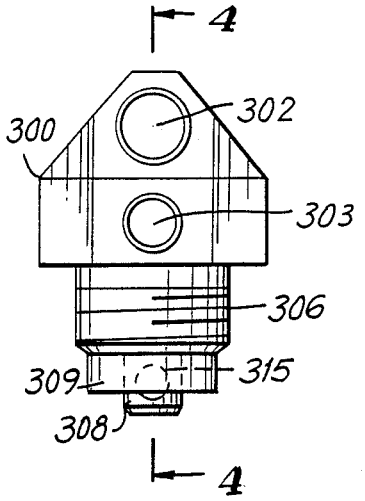
FIG. 2 is a front view of a preferred motive flow device, in accordance with the present invention.
Figure 3:
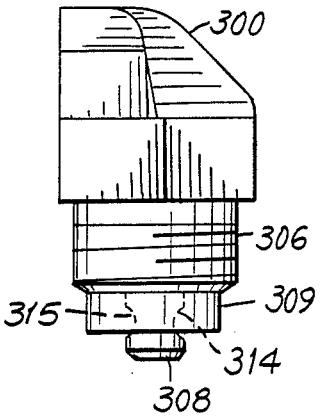
FIG. 3 is a side view of the motive flow device of FIG. 2.
Figure 4:
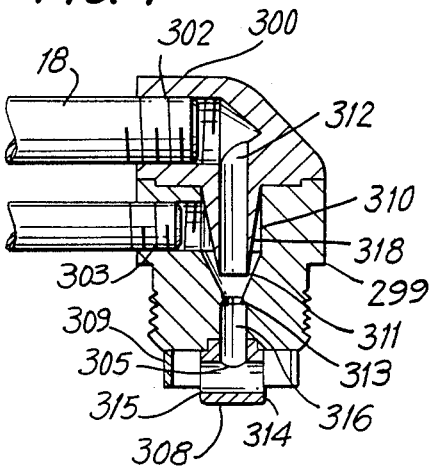
FIG. 4 is a cross section of the motive flow device, as taken along line A—A of FIG. 2.
Figure 5:
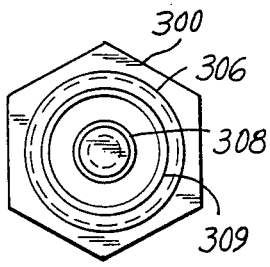
FIG. 5 is a bottom plan view of the motive flow device.

The following description of a preferred embodiment of the system which constitutes the present invention begins with an overall view of the arrangement of its components. It continues with an explanation of its operation, showing how each of the various components contributes toward the improved collection process. This is followed by a more detailed discussion of the structure and internal operations of the novel components of this invention and of the particular prior art components most effective for the operation of this invention.

In accordance with conventional practice, the basic arrangement of this oil breather recovery system consists of an aircraft engine, generally indicated by the number 5, which is supported by an engine support structure 55, which is a portion of the rigid connect aircraft frame structure 60. The oil breather outlet 4 of the engine 5 is connected by means of a tube 3 to an oil separation device 200, which has a separate gas outlet 212 and an oil outlet 210. The gas outlet 212 leads to the atmosphere through a series of pipes 76, 77, and the oil outlet 210 leads to the suction inlet 303 of the motive force pump 300, through a similar series of pipes 11, 11*a*. This motive force pump 300 has a second inlet 302 in fluid flow connection with the outlet from the scavenger pump 15. This motive force pump 300 has an interior geometry designed such that the fluid flow through the second inlet 302 generates a negative presence, or suction force, at the suction inlet 303. The outlet 309 of the pump is mounted into and extends through an opening in the engine lower case 15.

As this invention provides an improved method for the recovery of oil, a description of its operation is helpful to an understanding of its basic concepts.

One method of describing the operation of the system is to follow the oil and gases from the engine breather outlet until the gases are vented to the atmosphere and the recovered oil is returned to the engine oil reservoir.

When the engine is in operation, a mixture of exhaust gases along with a significant amount of recoverable oil passes from the engine breather outlet 4, into tube 3 and then to the inlet 211 of an oil separation device, generally indicated by the numeral 200. The oil separation device 200, effectively separates the oil from the exhaust gases, which are vented to the atmosphere from the bottom outlet tube 212, through a hose 76 and then through another outlet tube 77. This outlet tube 77 can also include additional conventional features such as an aft chamber at the exit 9 and louvered vents 8 along the outlet tube 77.

The liquid oil is drawn by the suction supplied by the motive force device 300, from the oil separation device 200, through the oil return outlet 210 and oil return lines 11, 11*a*, to the lower engine case oil reservoir 15, or crankcase. From the oil return outlet 210, the oil is immediately directed to an oil level shut off valve 400, which closes when there is insufficient oil flow from the oil separation device 200, thereby preventing any flow of gas from the outlet 210

A check valve 20 is also located along the oil return lines 11, 11*a*, and has the function of preventing the flow of oil in the opposite direction through the tube 11, 11*a* to the oil-gas separator 200.

The motive flow suction device 300 provides the pressure drop to maintain continuous oil flow back to the oil reservoir 15, from the breather oil recovery device 200, through the return lines 11, 11*a*.

Figure 6:
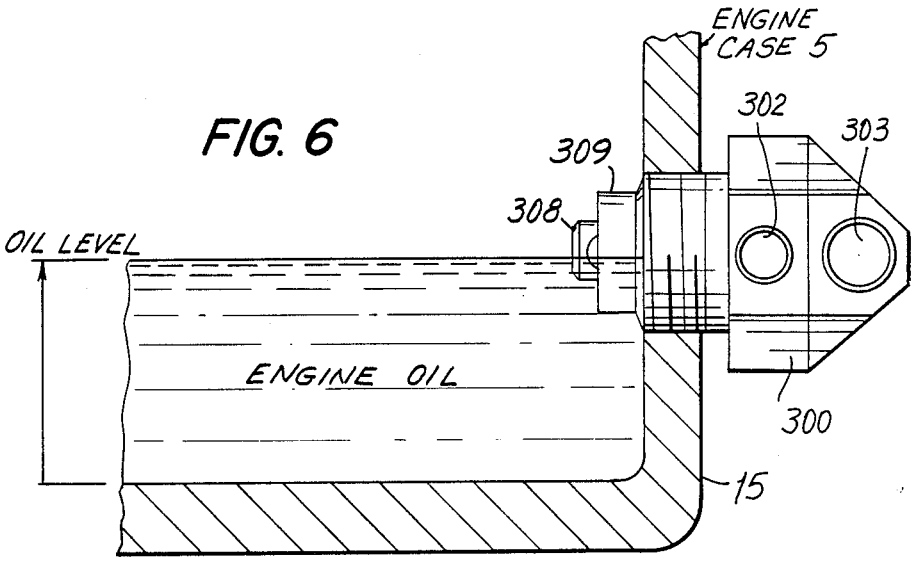
FIG. 6 is a cross section view of the motive flow device taken along line 6—6 of FIG. 1.

The motive flow pump 300 is mounted, e.g. threadedly, into an opening into the engine oil reservoir 15, and, as shown in FIG. 6, the outlet Tee 308 and diffuser ring 309 extend into the reservoir 15.

The inlet port channel 303 opens into a transversely aligned (preferably perpendicular) cylindrical chamber 310, which extends into a coaxial conical chamber 311; the internal diameter of the conical chamber 311 is continuously reduced in an axial direction away from the inlet port channel 303. The minimum diameter of the conical chamber 311 is located at the end adjacent an orifice 313. The orifice 313 opens into another, larger diameter, coaxial outlet channel 316.

In the preferred embodiment depicted in the drawings, the outlet channel 316 extends into a transversely aligned (preferably perpendicular) Tee channel 305, having exit ports 314, 315. An outer collar 309, or diffuser ring, extends around the Tee channel 305, preferably extending only partially along the diameter of, i.e. partially covering, the exit ports 314, 315.

The second inlet port 302, and inlet line 18, open into a transversely aligned (preferably perpendicular) nozzle channel 312, which has a smaller internal diameter than does the inlet line 18, and has a conical external surface 318, terminating at a nozzle opening surface 301. The nozzle channel 312 and conical external surface 318 are both coaxial with and extend into the cylindrical chamber 310 and conical chamber 311, the nozzle opening surface terminating upstream of the short orifice channel 313. As shown in the drawings, the housing 298 defining the second inlet port 302 and nozzle channel 310 is rigidly and sealedly secured to the suction housing 299.

In operation, the oil from the return lines 11, 11*a*, is drawn into the suction port 303 of the motive flow pump, and then to the conical chamber 311.

The suction force drawing the oil from the return line 11*a* into the suction port 303 is generated by the continuous flow of oil or oil/gas mixture into the second inlet port 302 from the scavenge pump 15, through the scavenge line 18. This oil, or motive flow fluid, then enters the smaller diameter nozzle passage 312, where its linear speed increases, passes through the nozzle orifice 301, and then passes into the conical chamber 311, where it mixes with the oil from the suction port 303. The recovered oil from the oil recovery device drain line 11*a* attached to port 302 is drawn into chamber 311 as a result of the negative differential pressure caused by the motive flow fluid velocity through the nozzle orifice 301 and the mixed flow through the orifice channel 313, and the exit channel 316. The combined fluid flow from the exit channel 316 passes into the transverse Tee channel 305, exiting from each end 314, 315, and impinges against the inner surface of the diffuser ring 309.

It has been found that careful attention to the dimensions of the various channels and orifices in the motive flow pump 300 can enhance its efficiency; specifically, the nozzle passage 312 can have an internal diameter of 0.15 in., and an outside diameter at the nozzle opening 301 of 0.19 in. The radial clearance between the outer diameter of the nozzle orifice 301 and the inner surface of the conical chamber 311 is 0.020 in. The minimum diameter of the conical chamber 311; i.e. the diameter of the orifice 313, is 0.190 in.; and the diameter of the exit channel 316 is 0.210 in. The transverse outlet Tee channel 305, has a diameter of 0.230 in. The outer collar, or diffuser ring 309, has an internal diameter of 0.68 in. The outer diameter of the outlet Tee 308 is 0.38 in., and thus the width of the annular space between the outlet ports 314, 315, and the internal surface of the diffuser ring 309 is 0.15 in. The diffuser ring 309 extends axially to cover about 60 percent of the diameter of the Tee exit ports 314, 315, thus only partially blocking the flow of the fluid exiting the outlet Tee 308. The scavenge pump return line 18 has an internal diameter of 0.28 in., and the recovered oil line 11*a* has an internal diameter of 0.17 in.

The motive flow pump 300, as shown in FIGS. 2 through 6, is designed to be secured directly to the lower part of the engine case 15 by means of threads 306. It has been determined empirically that if the Tee outlet 305 and the diffuser ring 309 are not provided, its performance, or the amount of suction provided by the motive flow pump 300, can vary significantly depending upon whether or not the motive flow device outlet 316 is immersed in oil in the engine case. Thus, if the motive flow device 300 is attached to the engine case 5 near the surface of the oil within the reservoir, then, variations in the engine oil level will affect the performance of the motive flow device. It has been found that if the outlet flow from outlet channel 316 is diverted, e.g. as by the outlet Tee 308 and a diffuser ring 309, the negative, or suction, pressure at the port 303 is substantially independent of variations in the engine oil level. The outlet Tee 308 and diffuser ring 30 act to prevent the engine oil level from affecting the negative pressure head generated by the motive flow device on the recovered oil flow.

Figure 11:
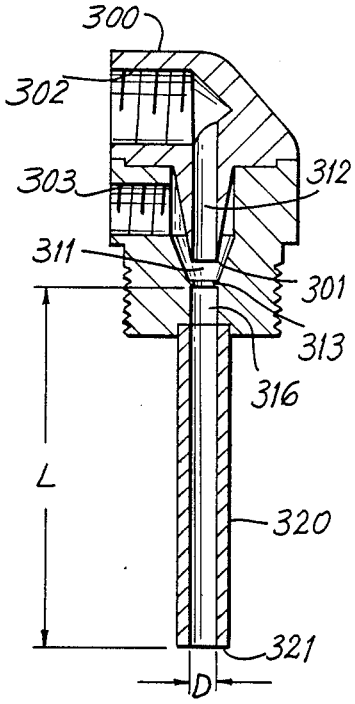
FIG. 11 is a cross section view of an alternative embodiment of the motive flow device.

It has also been found that by attaching a long external tube 320 (see FIG. 11) to effectively extend the length of the outlet channel 316, almost the same effect can be obtained.

Empirically, it is shown that the effective total length of the outlet channel 316 and the external tube 320 (designated as "L" in FIG. 11), must be within certain limits, in order to provide an acceptable negative pressure, or suction, at the inlet port 303, which suction is not dependant upon whether or not the outlet end 321 of tube 320 is immersed in oil. For the illustrated embodiment, the range for L is from about 2 ins. to about 3 ins., with an optimal value of L at 2.5 ins. The effective ratio of the length, L, to the internal diameter, D, of the combined outlet channel 316 and the external tube 320, i.e., "L/D", is in the range of from about 10 to 14, with an optimal value of about 11.9.

However, a long tube 320 extending into the engine oil reservoir 5 is disadvantageous where there are moving mechanical parts in the crank case. In addition, the configuration of FIG. 11, including the long extension tube 320, is more affected by changes in oil velocity than is the configuration of FIGS. 2 through 5.

Figure 7:
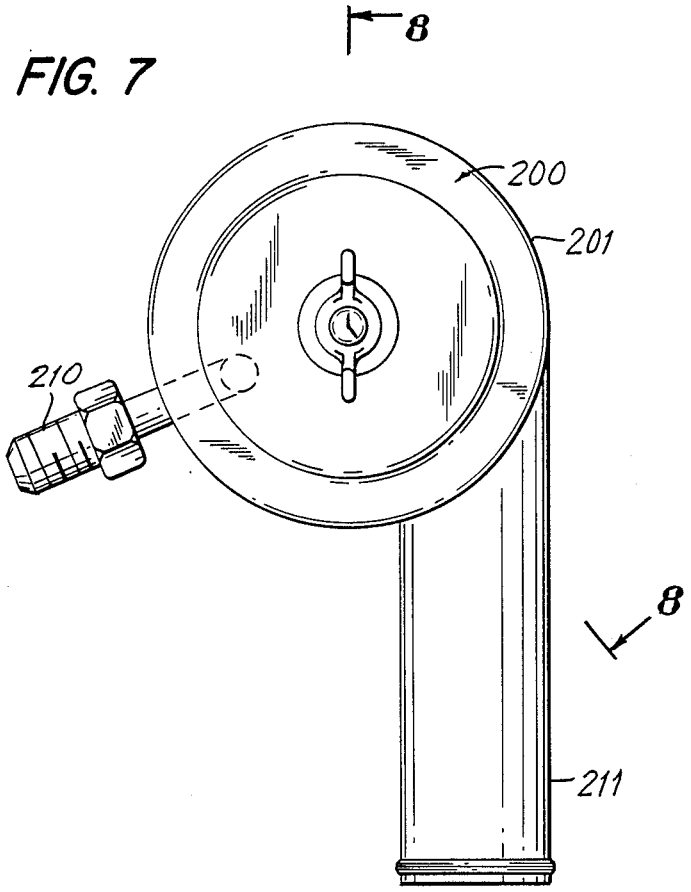
FIG. 7 is an enlarged top plan view of the oil separator device of FIG. 1.
Figure 8:
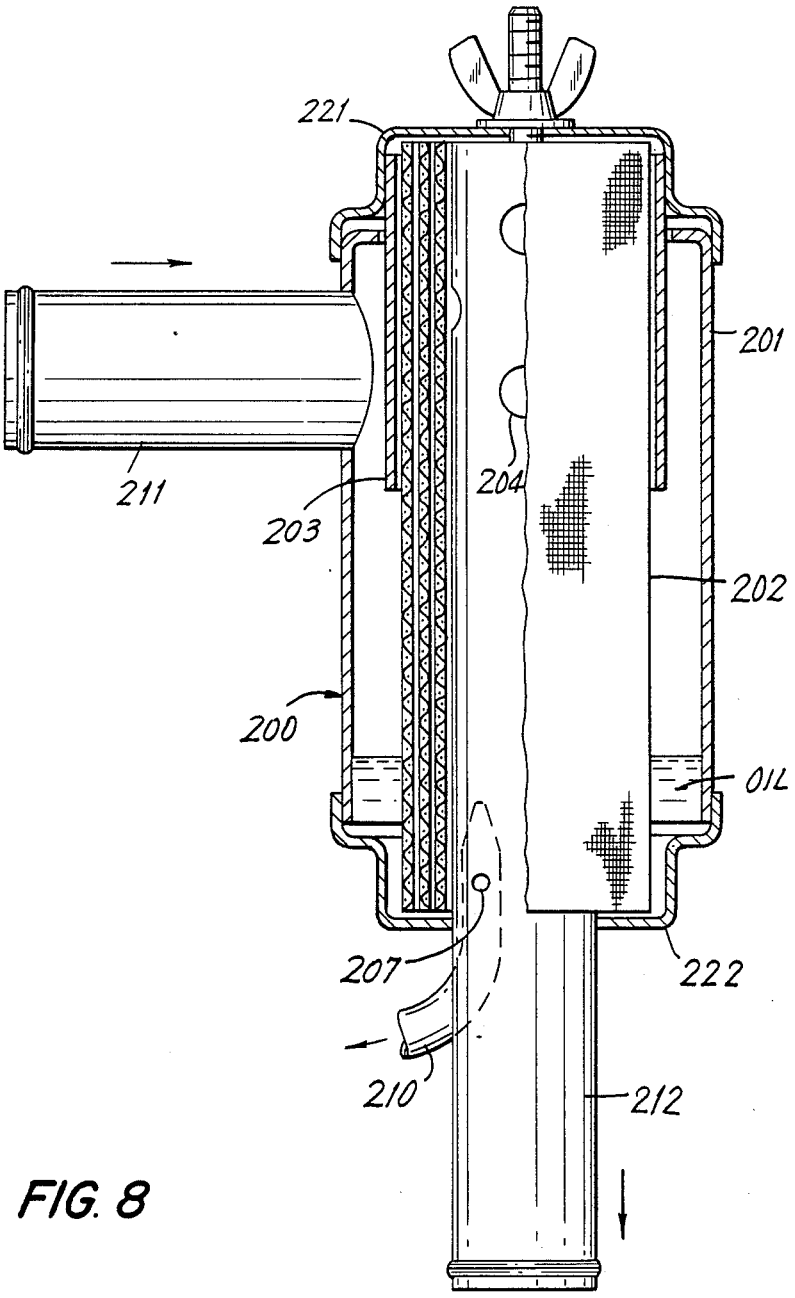
FIG. 8 is a cross section view taken along line 8—8 of FIG. 7.

For this system to work at optimal effectiveness, several conventional components are provided. One of these is a more efficient oil separation device 200, to more effectively separate the oil from the vapor emitted by the engine. An example of such a device, generally indicated by the number 200 in FIG. 1, is shown in greater detail in FIGS. 7 and 8. The mixture of oil and gases exiting the engine breather 4, enters through an inlet tube 211, which is positioned at the top of, and tangential to the side of the cannister 201, near the cap 221. This oil/vapor mixture is then directed, by a baffle ring 203, in a circular or vortex motion within the cannister 201. Next, the mixture is directed inward through a filter 202; the vapors pass through a hole 204, into the outlet tube 212, and then into tube 76. The oil collects at the bottom portion 222 of the cannister 200. It then overflows through the opening 207 and then through lines 11, 11*a*, for returning the recovered oil to the engine oil reservoir 5.

If desired, a check valve 20 can be placed in the oil return line 11 to prevent oil from being pumped back up the oil breather return line in the event an obstruction should occur downstream from the motive flow pump orifice 301. Also, within the oil separation device, a flow throttling orifice 207 can be placed in the oil return outlet in order to regulate the return oil flow rate.

Figure 9:
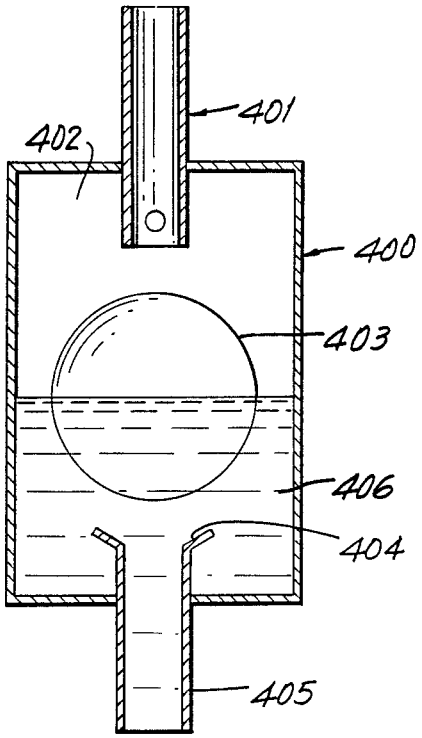
FIG. 9 is an enlarged cross section view, taken along line 9—9, of the ball float shut off valve of FIG. 1.

Optionally, also, an oil level shut off valve 400 can be placed in the return line 11, 11*a* in order to prevent air from being mixed with the motive flow fluid when all of the oil is drained from the oil breather recovery device 100. A cross-sectional view of an example of an oil shut off valve is shown in FIG. 9. Here, oil or air enters the valve 400 through an inlet tube 401. Contained within the valve cavity 402 is a ball float 403. As long as there is sufficient oil within the cavity 402, the ball float remains above the valve seat 404 which is situated on the outlet tube 405. If the oil level 406 falls too low, the ball float 403 will, due to gravity, position itself onto the valve seat 404 and thus prevent air from entering the outlet tube 405.

Figure 10:
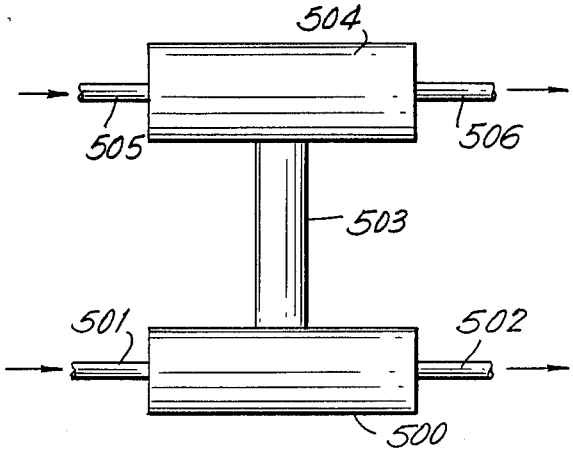
FIG. 10 is a schematic representation of an alternate breather pumping mechanism, a mechanically coupled hydraulic motor and pump device.

In the above embodiment, the motive flow liquid from the scavenge pump is mixed with the oil returned from the oil breather recovery device 200. However, as it may be desired in some applications not to mix these fluids, an alternate pumping device can be utilized. An example of such a device, as shown in FIG. 10, utilizes a hydraulic motor 500 mechanically coupled to a hydraulic pump 504 via a shaft 503. The power fluid enters the motor 500 at the inlet 501, generating a motive force which is transmitted via the shaft 503 to the pump 504, and is exhausted at the exit 502. Similarly, the recovered oil from the oil separation device 200 is drawn into the pump 504 at its inlet and is exhausted at its exit port 506 back to the engine case 5. The hydraulic motor and pump can be of any standard configurations, such as turbine units.

For engine configurations which do not have a turbocharged oil scavenge pump, the pressurized oil flow to or from an external oil cooler can be used as an alternative motive flow. Alternatively, any engine oil flow source can be used to provide the motive flow.

The embodiments of the present invention particularly disclosed are presented merely as examples of the invention. Other embodiments, forms and modifications of the invention coming within the proper scope of the appended claims will, of course, readily suggest themselves to those skilled in the art.

What is claimed is:

1. An engine breather oil recovery system, for use with reciprocating engines having an oil breather and an oil reservoir recovery system, comprising:
   (a) an engine breather outlet from the engine;
   (b) a vapor and oil separator device in fluid flow connection with the engine breather outlet;
   (c) a motive flow suction means in fluid flow connection between the separator device and the engine, so as to provide a substantially continuous pressure drop between the separator device and the engine oil reservoir;
   (d) an engine fluid system in parallel with the separator device; and (e) an engine driven pump in fluid flow connection with such other engine fluid system, wherein the motive force for the motive flow suction means is provided by the fluid from the engine pump.

2. A system as described in claim 1 wherein the motive flow suction means is a device, comprising;
   (i) a motive flow inlet for the fluid providing the motive flow force;
   (ii) an interior orifice, at the interior end of the motive flow inlet;
   (iii) a larger channel in fluid flow relationship with the orifice, orifice opening into the larger channel in the direction of fluid flow;
   (iv) a suction inlet, open to the larger channel; and
   (v) a pump outlet from the larger channel 3. A system as described in claim 2 further comprising:
   (vi) a short channel orifice in intermediate fluid flow connection between the larger channel and the pump outlet, the channel orifice having a flow diameter less than the larger channel and the pump outlet.

4. A system as described in claim 3 wherein the motive flow suction means device further comprises;
   (vii) an outlet tee at the pump outlet from the interior orifice, for diverting the outlet flow transversely; and
   (viii) a diffuser ring, surrounding the outlet tee, and which, together with the outlet tee, enables the device to provide a negative or suction pressure that is substantially independent of the engine oil reservoir level relative to the outlet.

5. A system as described in claim 4, wherein the motive flow suction means device is threadedly connected to the engine lower case.

6. A system as described in claim 3, wherein the motive flow suction means device further comprises;
   (vii) an external tube defining an extension channel in continuing fluid flow relationship with the pump outlet and extending into the oil reservoir, the total length of the extension channel and the pump outlet is from ten to fourteen times the diameter of the channel.

7. A system as described in claim 1, wherein the motive flow suction means is a hydraulic motor and pump device, which comprises:
   (a) a hydraulic motor, driven by the motive flow fluid;
   (b) a hydraulic pump connected to the shaft, and in fluid flow connection between the vapor and oil separator device and the oil reservoir; and
   (c) mechanical drive means operatively connected between the hydraulic motor and the pump.

8. A system as described in claim 1, which further comprises a check valve, in fluid flow connection between the air and oil separator device and the motive flow suction means, to prevent the reverse flow of oil in the line where the check valve is installed.

9. A system as described in claim 1, which further comprises an oil shut-off valve in fluid flow connection between the air and oil separation device and the motive flow suction means, and designed to close when the oil level in the oil shut-off valve device falls below a minimum level.

10. In an engine breather oil recovery system, for use with reciprocating engines, an oil breather outlet from the engine, an oil reservoir in the engine, separating means for collecting oil which escapes along with vapor from the oil breather outlet, and breather oil conduit means interconnecting the separating means and the oil reservoir, the engine also being provided with an independently driven oil pumping system in parallel with the breather oil recovery system for returning oil to the oil reservoir and comprising a pumping conduit in fluid flow connection with the engine oil reservoir; the improvement which comprises a motive flow pumping means comprising a motive force means in fluid flow relationship between the pumping conduit and the engine oil reservoir and a pump means in fluid flow relationship between the breather oil conduit means and the engine oil reservoir, and force transmitting means between the pump means and the motive force means whereby the pump is driven by the motive force means.

11. A system as described in claim 10, wherein the means for providing the pressure drop is a device which comprises;
   (a) a hydraulic motor, driven by the fluid providing motive flow force;
   (b) a shaft connected to the hydraulic motor; and
   (c) a hydraulic pump connected to the shaft, in fluid flow connection between the vapor and oil separator device and the oil reservoir.

12. In an engine breather oil recovery system, for use with reciprocating engines, an oil breather outlet from the engine, an oil reservoir in the engine, means for collecting oil which escapes along with vapor from the oil breather outlet, and breather oil conduit means interconnecting the collecting means and the oil reservoir, the engine also being provided with an independently driven oil pumping system in parallel with the breather oil recovery system for returning oil to the oil reservoir and comprising a pumping conduit in fluid flow connection with the engine oil reservoir; the improvement which comprises a motive flow suction pump for providing a substantially continuous pressure drop between the collecting means and the engine oil reservoir, the suction pump comprising a suction inlet in fluid flow connection to the breather conduit, a motive fluid inlet in fluid flow connection with the pumping conduit, and aspirating means in fluid flow connection between the suction inlet and the motive fluid inlet, serving to provide the reduced pressure at the suction inlet.

13. A system as described in claim 12, wherein the means for providing the reduced pressure is a device which comprises:

(a) an inlet for the fluid providing the motive flow force;

(b) an interior orifice, at the interior end of the inlet for the fluid providing motive flow force, this orifice becoming narrower in the direction of fluid flow;

(c) a suction inlet, open to the interior orifice;

(d) an outlet from the interior orifice for the fluids.

14. A system as described in claim 13, wherein the means device for providing the pressure drop further comprises;

(e) an outlet tee at the outlet from the interior orifice, for diverting the outlet flow; and (f) a diffuser ring, coupled with the outlet tee, which, together with the outlet tee, enables the device to provide a negative or suction pressure that is substantially independent of the engine oil reservoir level.

* * * * *